United States Patent [19]

Tsuzurahara

[11] Patent Number: 4,797,596

[45] Date of Patent: Jan. 10, 1989

[54] FILTER APPARATUS FOR A MAGNETRON

[75] Inventor: Mamoru Tsuzurahara, Mobara, Japan

[73] Assignee: Hitachi, Ltd., Tokyo, Japan

[21] Appl. No.: 93,214

[22] Filed: Sep. 4, 1987

[30] Foreign Application Priority Data

Sep. 8, 1986 [JP] Japan ..... 61-209489
Sep. 8, 1986 [JP] Japan ..... 61-209490

[51] Int. Cl.[4] ..... H01J 25/50
[52] U.S. Cl. ..... 315/5.13; 315/39; 315/40
[58] Field of Search ..... 315/5.13, 39, 39.51, 315/39.67, 40, 58, 71; 333/182, 185, 184, 206

[56] References Cited

U.S. PATENT DOCUMENTS 2,538,597 1/1951 Steele ..... 315/5.13
3,859,558 1/1975 Harada et al. ..... 315/39.51
3,922,612 11/1975 Tashiro et al. ..... 315/39.51
4,104,561 8/1978 Iwata ..... 333/182

*Primary Examiner*—David K. Moore
*Attorney, Agent, or Firm*—Antonelli, Terry & Wands

[57] ABSTRACT

A filter for preventing an electromagnetic wave from leaking from a cathode line of a magnetron comprises an inductance element connected in series to the cathode line and a reactance element of a coaxial structure including a portion of the cathode line as a center conductor, a surrounding dielectric material and a surrounding metal conductor. A cup-shaped conductor is arranged around the reactance element to form a parallel inductance component to the cathode line.

8 Claims, 4 Drawing Sheets

FILTER APPARATUS FOR A MAGNETRON

BACKGROUND OF THE INVENTION

The present invention relates to a filter apparatus for a magnetron, and more particularly to a structure of an impedance device of the filter.

The filter is used to block a leakage electromagnetic wave from the magnetron in order to prevent the leakage electromagnetic wave from disturbing an external electronic apparatus. Particularly, an electromagnetic wave which leaks externally through a current supply line extending from a cathode of the magnetron to a power supply causes a serious problem. A filter for the leakage electromagnetic wave from the cathode line usually comprises a choke coil and a feed-through type capacitor, which is designed to exhibit a high impedance to a frequency of the leakage electromagnetic wave and inserted in the cathode line circuit.

An example of such filter is shown in Japanese patent application No. JP-A-60-243941 filed by Hitachi, Ltd. on May 18, 1984.

The prior art filter uses the expensive feed-through type capacitor as the impedance element and hence raises a problem in a manufacturing cost. Accordingly, it is desined to develop a filter which is of simpler structure and positively blocks the leakage of the electromagnetic wave.

SUMMARY OF THE INVENTION

It is an object of the present invention to provide a filter of a simple structure which uses a coaxial reactance element instead of a conventional feedthrough type capacitor.

It is another object of the present invention to provide a filter of an integral structure of a capacitance component and an inductance component by forming the high impedance component by utilizing a portion of the coaxial reactance element.

In order to achieve the above objects, in accordance with one embodiment of the present invention, a cathode line is surrounded by a dielectric material, which is surrounded by a conductive material to form a coaxial structure, which is used as a capacitance element. In accordance with another embodiment, the coaxial structure is surrounded by a further conductive material so that a high impedance is formed in series with the cathode line via the capacitance element.

The other objects of the present invention will be apparent from the following description when taken with the accompanying drawings.

DESCRIPTION OF THE PREFERRED EMBODIMENTS

Figure 1:
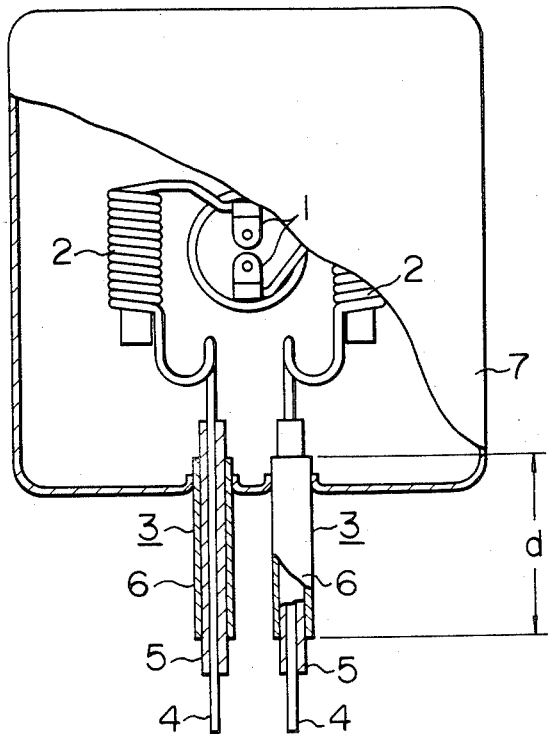
FIG. 1 shows an outer view of a first embodiment of the filter of the present invention.

FIG. 1 shows a first embodiment of the filter of the present invention. A magnetron is not shown in FIG. 1. Numeral 1 denotes a terminal connected to a cathode of the magnetron. First ends of choke coils 2 which are inductance elements are connected to the cathode terminals 1. Reactance elements 3 are connected to the other ends of the choke coils 2. The reactance element 3 has a coaxial structure comprising a cathode line 4 for supplying a cathode current from a power supply (not shown) as a center conductor, a tubular dielectric material 5 surrounding the center conductor 4 and a tubular conductive material 6 surrounding the dielectric material 5. The dielectric material 5 may be ceramics such as alumina ceramics and the conductive material 6 may be metal. The coaxial reactance element 3 extends through a wall of a shield case 7, and the outer peripheral conductive material 6 is contacted and soldered to the shield case 7 to prevent leakage of an electromagnetic wave. The electromagnetic wave generated in the magnetron tends to leak from the cathode terminal 1 to the cathode line 4 but it is blocked by the filter circuit comprising the series inductance element 2 and the parallel reactance element 3.

Figure 2:
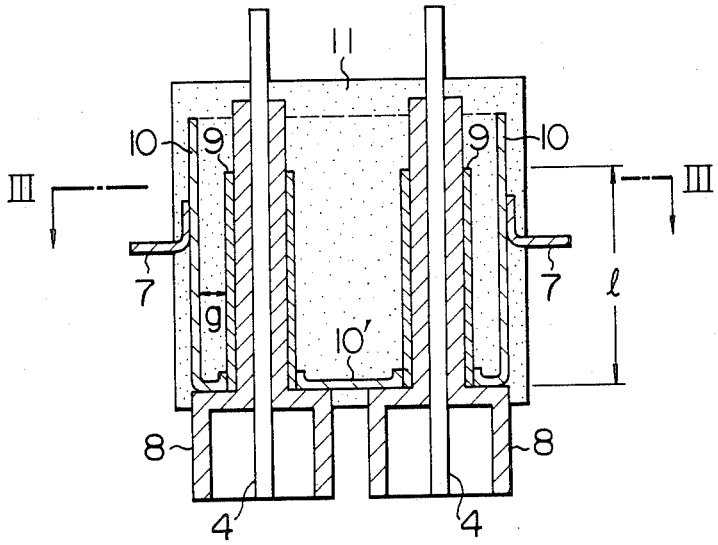
FIG. 2 shows a partial sectional view of a second embodiment of the filter of the present invention.

FIG. 2 shows a second embodiment of the filter of the present invention. In FIG. 2, the inductance element 2 and the shield case 7 shown in FIG. 1 are omitted. The capacitance element has a coaxial structure comprising a center conductor 4, a surrounding dielectric material 8 and a surrounding metal member 9. In the present embodiment, a cup-shaped conductor 10 surrounds the metal conductor 9. The cup-shaped conductor 10 has a bottom 10′ through which the coaxial capacitance element extends. An outer periphery of the cup-shaped conductor 10 is connected to the shield case 7. The capacitance element and the cup-shaped conductor 10 are molded by resin 11 to import mechanical strength to the filter. A length l along which the metal conductor 9 of the capacitance element and the cup-shaped conductor 10 face each other is selected to $\lambda/4$ (where $\lambda$ is a wavelength of the electromagnetic wave generated by the magnetron) if a dielectric constant of the mold resin 11 is substantially equal to 1 so that it exhibits a maximum choke effect to the electromagnetic wave of that wavelength. The length l may be shortened by selecting a large dielectric constant for the mold resin 11. An optimum choke effect may be attained by properly selecting a gap g between the metal conductor 9 and the cup-shaped conductor 10, and the length l. The mold resin 11 is not always necessary.

Figure 3:
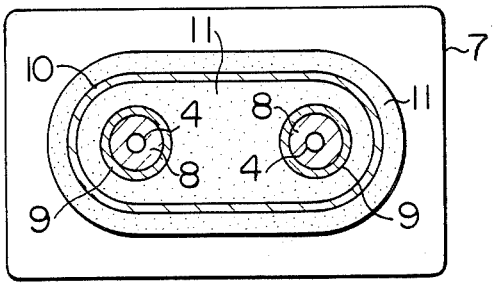
FIG. 3 shows a sectional view taken along a line III—III of FIG. 2.

FIG. 3 shows a sectional view taken along a line III—III of FIG. 2. The cup-shaped conductor 10 surrounds the two coaxial capacitance elements.

Figure 4:
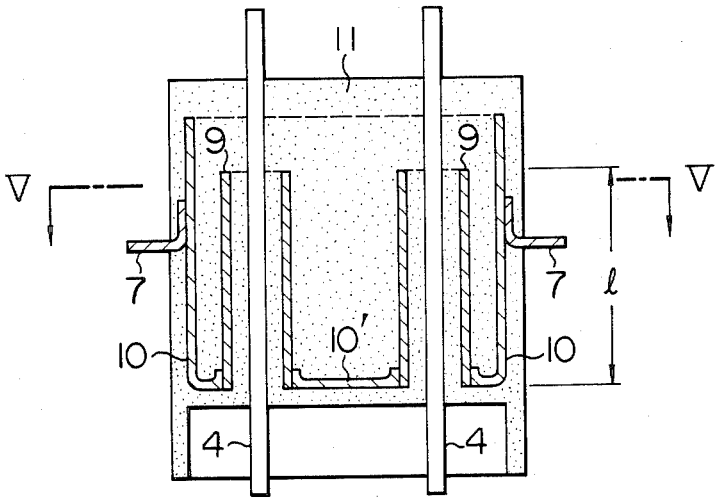
FIG. 4 shows a partial sectional view of a third embodiment of the filter of the present invention.
Figure 5:
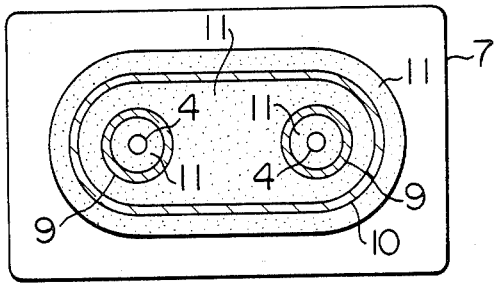
FIG. 5 shows a sectional view taken along a line V—V of FIG. 4.

FIG. 4 shows a third embodiment of the filter of the present invention. In the present embodiment, the mold resin 11 takes place of the dielectric material 8 of FIG. 2. The dielectric constant of the resin 11 is properly selected. The third embodiment simplifies the structure of the capacitance element. FIG. 5 shows a sectional view taken along a line V—V of FIG. 4.

The mold resin 11 is also filled in a space between the metal conductor 9 and the center conductor 4 so that it functions as a dielectric material of the capacitor. The high impedance component is generated in the same manner as that in the embodiment of FIG. 2.

Figure 6:
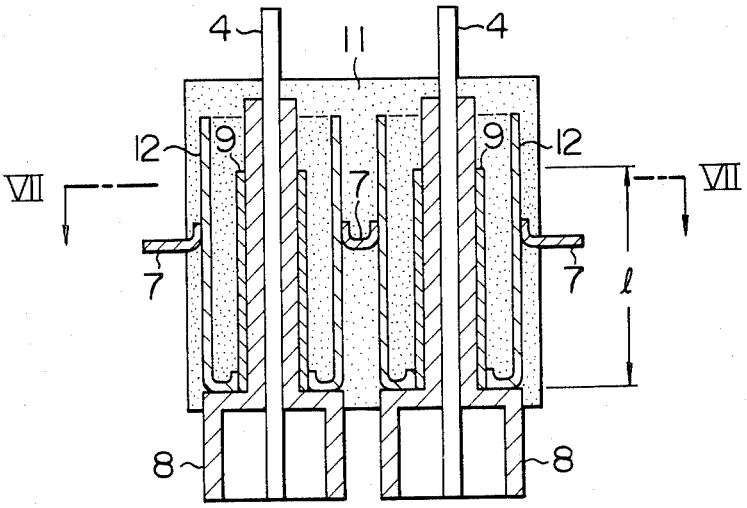
FIG. 6 shows a partial sectional view of a fourth embodiment of the filter of the present invention.
Figure 7:
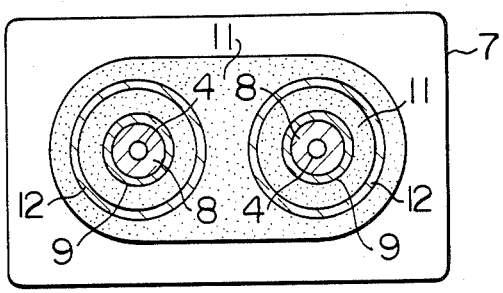
FIG. 7 shows a sectional view taken along a line VII—VII of FIG. 6.

FIG. 6 shows a fourth embodiment of the filter of the present invention. FIG. 7 shows a sectional view taken along a line VII—VII of FIG. 6. In the present embodiment, the cup-shaped conductor 12 is arranged around the metal conductor 9 of the capacitance element. In this structure, the choke effect of the high impedance component is superior to those of FIGS. 2 and 4.

Figure 8:
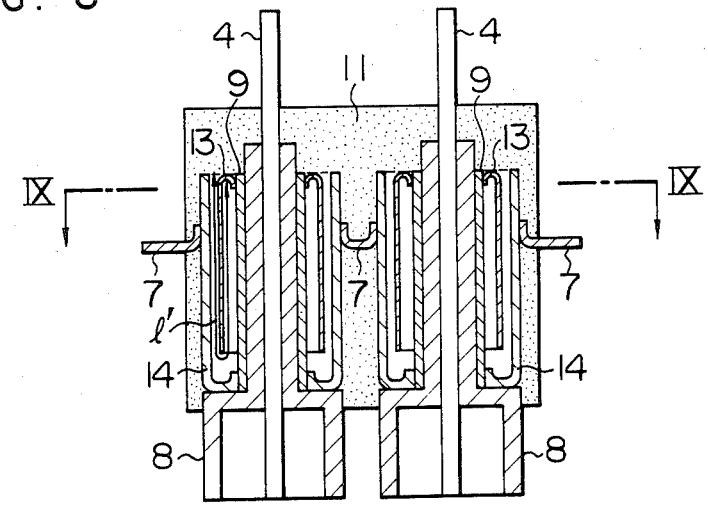
FIG. 8 shows a partial sectional view of a fifth embodiment of the filter of the present invention.
Figure 9:
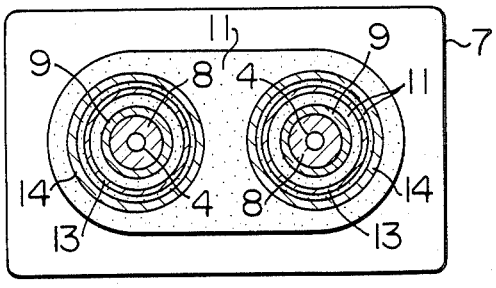
FIG. 9 shows a sectional view taken along a line IX—IX of FIG. 8.

FIG. 8 shows a fifth embodiment of the filter of the present invention, and FIG. 9 shows a sectional view taken along a line IX—IX of FIG. 8. In the present embodiment, dual cup-shaped conductors are arranged around the metal conductor 9. The outer periphery of the capacitance element has its one end connected to the metal conductor 9, the first cup-shaped conductor 13 surrounds the metal conductor 9, and the second cup-shaped conductor 14 is connected to the other end of the metal conductor 9 and surrounds it. The resin 11 is filled in a space between the first and second cup-shaped conductors 13 and 14 and a space between the first cup-shaped conductor 13 and the metal conductor 9. By arranging the dual cup-shaped conductors around the capacitance element, the length l required to attain the same high impedance component as those of the second, third and fourth embodiments may be shorter. In the present embodiment, the length l' in FIG. 8 corresponds to the length l in FIGS. 2, 4, and 6. Thus, the present embodiment reduces the size of the filter.

In the above embodiments, the metal conductor 9 which surrounds the dielectric material 8 may be formed by rolling a metal plate into a tubular shape, sintering metal particles on the surface of the dielectric material 8, or depositing a metal film on the surface of the dielectric material by fusion or vapor deposition.

Figure 10:
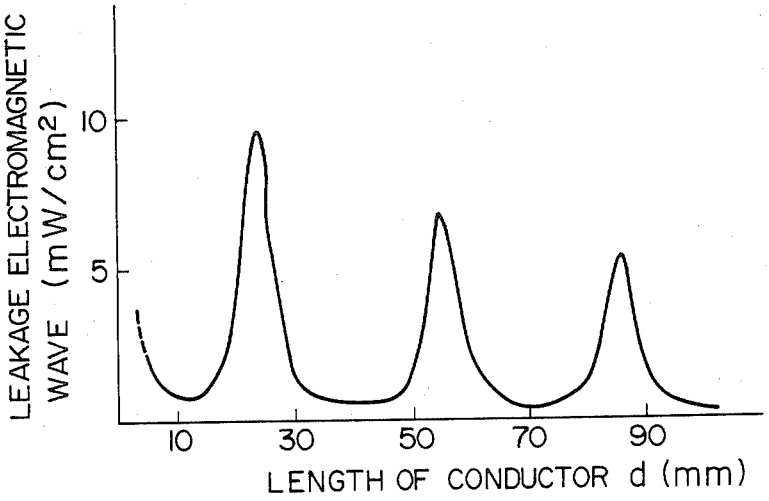
FIG. 10 shows a graph of a characteristic of the filter in the embodiment of FIG. 1.

FIG. 10 shows a measurement of intensity of leakage of a fundamental wave (frequency 2,450 MHz) of the electromagnetic wave generated by the magnetron, out of the shield case from the cathode line 4 in the embodiment of FIG. 1 when the length d of the external conductor 6 is changed. It is seen from the measurement that the leakage of the fundamental wave is minimum when the length d of the conductor 6 is 6–18 mm, 35–45 mm and 65–75 mm.

Figure 11:
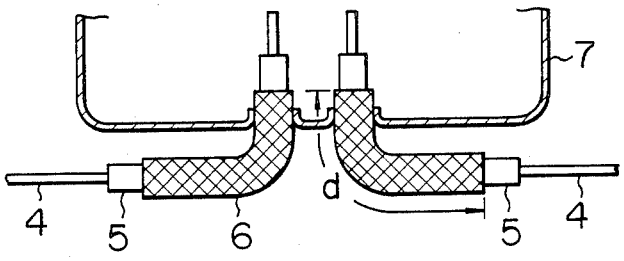
FIG. 11 shows a sixth embodiment of the filter of the present invention.

FIG. 11 shows a sixth embodiment of the filter of the present invention. In the present embodiment, the dielectric material 5 and the surrounding conductor 6 of the first embodiment are made of flexible material. For example, the dielectric material 5 may be made of teflon (trademark) and the conductor 6 may be a woven wire of thin metal wires. When such a flexible reactance element is used, mounting is facilitated when the magnetron is mounted in a microwave oven or other equipment. The length d of the flexible conductor 6 is set to be a product of the length d defined above multiplied by a square root of a ratio of a specific dielectric constant of alumina to a specific dielectric constant of the dielectric material 5, for compensating for a difference between the specific dielectric constants.

I claim:

1. A filter for reducing electromagnetic wave energy leakage from an electrode wiring of a magnetron, comprising:

(a) a cathode line for supplying a current to a cathode of the magnetron;

(b) an inductance element connected between said cathode and one end of said cathode line;

(c) capacitance means having a coaxial structure including a dielectric material surrounding said cathode line and a first conductor surrounding said dielectric material for imparting a capacitive parallel impedance as viewed from an electromagnetic wave source of said magnetron; and (d) high impedance means including a second conductor having a portion thereof connected to the first conductor of said capacitance means and surrounding the coaxial structure of said capacitance means to impart an inductive parallel high impedance as viewed from said electromagnetic wave source, said second conductor being in the shape of a cup and containing said capacitance means.

2. A filter for reducing electromagnetic wave energy leakage from an electrode wiring of a magnetron, comprising:

(a) a cathode line for supplying a current to a cathode of the magnetron;

(b) an inductance element connected between said cathode and one end of said cathode line; and (c) capacitance means of a coaxial structure having a dielectric material surrounding said cathode line and a first conductor surrounding said dielectric material; and (d) high impedance means including a second conductor having a portion thereof connected to said first conductor and surrounding the coaxial structure of said capacitance means to form a high impedance in parallel with said cathode line, said second conductor being in the shape of a cup and containing said capacitance means.

3. A filter according to claim 2 wherein said second conductor of said high impedance means surrounds all of said capacitance means.

4. A filter according to claim 2 wherein said high impedance means comprises a plurality of conductors each of which surrounds said capacitance means, respectively.

5. A filter according to claim 3 wherein said cathode line, said capacitance means and said high impedance means are molded by insulative resin to impart physical strength to the filter, and the dielectric material of said capacitance means is used as said mold resin.

6. A filter according to claim 4 wherein said second conductor of said high impedance means includes a third conductor having a portion thereof connected to said first conductor of said capacitance means and surrounding said capacitance means, and a fourth conductor connected to another portion of the first conductor of said capacitance means and surrounding said third conductor.

7. A filter for reducing electromagnetic wave energy leakage from an electrode wiring of a magnetron, comprising:

(a) a cathode line for supplying a current to a cathode of the magnetron;

(b) an inductance element connected between said cathode and one end of said cathode line; and (c) a coaxial structure comprising reactance means having a dielectric material surrounding said cathode line and a conductor connected to a ground potential surrounding said dielectric material to form a reactance between said cathode line and a ground potential, said coaxial structure having a length l selected to be within one of the ranges of 8–12 mm, 34–35 mm or 65–75 mm.

8. A filter according to claim 7 wherein the entire coaxial structure of said reactance means is flexible.

* * * * *